US005343589A

United States Patent [19]

Davenport

[11] Patent Number: 5,343,589

[45] Date of Patent: Sep. 6, 1994

[54] LOBBY DUST PAN

[75] Inventor: Robert A. Davenport, Sylvania, Ohio

[73] Assignee: Impact Products, Inc., Toledo, Ohio

[21] Appl. No.: 53,110

[22] Filed: Apr. 26, 1993

[51] Int. Cl.[5] ..... A47L 13/52

[52] U.S. Cl. ..... 15/257.4; 15/257.7; 16/110 R

[58] Field of Search ..... 15/257.4, 257.7, 143.1, 15/257.1; 294/19.1, 19.2, 57, 7; 16/110.1; 135/65, 66, 67, 72, 74, 75, 76

[56] References Cited

U.S. PATENT DOCUMENTS

| | | | |
|---|---|---|---|
| D. 276,668 | 12/1984 | Minniman | 135/65 |
| 390,781 | 10/1888 | Hebden et al. | 15/257.7 |
| 531,177 | 12/1894 | Gere | 15/257.4 |
| 1,203,697 | 11/1916 | Bump | 15/257.4 |
| 1,329,915 | 2/1920 | McKenzie | 135/65 |
| 2,978,731 | 4/1961 | Belluomini | 15/257.4 |
| 4,834,127 | 5/1989 | Van Sice | 135/76 |
| 4,837,666 | 6/1989 | Conkle | 135/65 |

FOREIGN PATENT DOCUMENTS

| | | | |
|---|---|---|---|
| 1694096 | 11/1991 | U.S.S.R. | 135/66 |
| 6704 | of 1894 | United Kingdom | 16/110.1 |
| 2011566 | 7/1979 | United Kingdom | 16/110.1 |

*Primary Examiner*—Timothy F. Simone
*Assistant Examiner*—Gary K. Graham
*Attorney, Agent, or Firm*—Marhsall & Melhorn

[57] ABSTRACT

A lobby dust pan of the type generally having a receptacle portion pivotally connected to a yoke. The yoke is flexible and is connected to a shaft. The yoke is deformable to enable latching means thereon to be retained with or released from a slot on the receptacle. The shaft in turn is connected to a novel handle having an axially extending body portion, a connecting portion formed proximate one end of said body portion and connected to the upper end of the shaft, and a transverse downwardly extending ridge portion formed at the other end of said body portion. The novel ridge portion of the handle permits the lobby dust pan to easily be carried over the arm of the user when moving from job to job, thus freeing the hands for other purposes. Also, it allows the lobby dust pan to be "hooked" over receptacle containers when temporarily not in use.

2 Claims, 2 Drawing Sheets

LOBBY DUST PAN

BACKGROUND OF THE INVENTION

1. Field of the Invention

The present invention relates to waste receptacles. More particularly, the present invention relates to a lobby dust pan of the type having a receptacle portion pivotally mounted to a shaft. The shaft, in turn, is mounted to an improved handle.

2. Description Of The Prior Art

Dust pans of the general type described herein are known in the prior art. Lobby dust pans have long been needed for cleaning small bits of waste, such as gum wrappers, candy wrappers, and other types of waste, from commercial areas, such as theaters and building lobbies. Generally, such lobby dust pans have a receptacle portion, which is pivotally mounted by various means well known in the art, to a shaft. The shaft is, in turn, connected to a ball-shaped handle, for example.

Generally, a tab is disposed at the bottom of the shaft adapted to be selectively received by a slot formed in the receptacle portion. When the lobby dust pan is used, the receptacle portion is placed in contact with the floor of the area to be cleaned, and a downward pressure is imposed on the ball-shaped handle. The receptacle portion is thereby caused to rotate to a right angle with the shaft. The tab enters the slot, causing the receptacle to be locked at a right angle with respect to the shaft and is maintained in such a relation while the lobby dust pan is being used.

When the immediate area is properly cleaned of the waste, downward pressure is once again placed on the ball-shaped handle. The downward pressure causes the hook-like tab to disengage from the slot. When the ball-shaped handle is lifted, the receptacle portion is so weighted that it will rotate to a position of axial alignment with the shaft to prevent the waste in the receptacle from falling out.

Prior art lobby dust pans had the ball-shaped handle to facilitate repeatedly putting the necessary downward pressure on the shaft to engage and disengage the tab from the slot as the dust pan was being used. It was thought that the ball-shaped handle, having a large area in contact with the palm of the user, lessened fatigue. However, it was found that maintaining a grip on the slippery ball-shaped handle while moving the dust pan from place to place during the cleaning operation actually caused more fatigue than the engagement and disengagement of the handle into and out of the upright position. Thus, those skilled in the art of waste receptacles continued a search for a satisfactory lobby dust pan.

SUMMARY OF THE INVENTION

To solve the problems longstanding in the prior art, a lobby dust pan having the known receptacle portion pivotally connected to a yoke is provided. The yoke is connected to a shaft which is, in turn, connected to an improved handle. The handle has an axially extending body portion. A connecting portion of the handle is formed proximate one end of the body portion, and press fit into the upper end of the shaft. A transverse, downwardly extending ridge portion is formed at the other end of the body portion. A trough may be provided in the axially extending body portion to facilitate application of pressure by the user.

It is an object of the invention to provide an improved lobby dust pan having a novel handle portion.

A further object of the present invention is to provide an improved lobby dust pan having ergonomic benefits for the user.

A still further object of the present invention is to provide an improved lobby dust pan which is less fatiguing to the user.

Other objects and advantages of the invention will become apparent from reading the following detailed description of the invention and appended claims, reference being had to the accompanying drawings forming a part of the specification, wherein like reference characters designate corresponding parts in the several views.

It is to be understood that the present invention is not limited in its application to the details of construction, and arrangement of parts illustrated in the accompanying drawings, since the invention is capable of other embodiments, and of being practiced or carried out in various ways within the scope of the appended claims. Also, it is to be understood that the phraseology and terminology employed herein is for the purpose of description, and not of limitation.

DESCRIPTION OF THE PREFERRED EMBODIMENT

Figure 1:
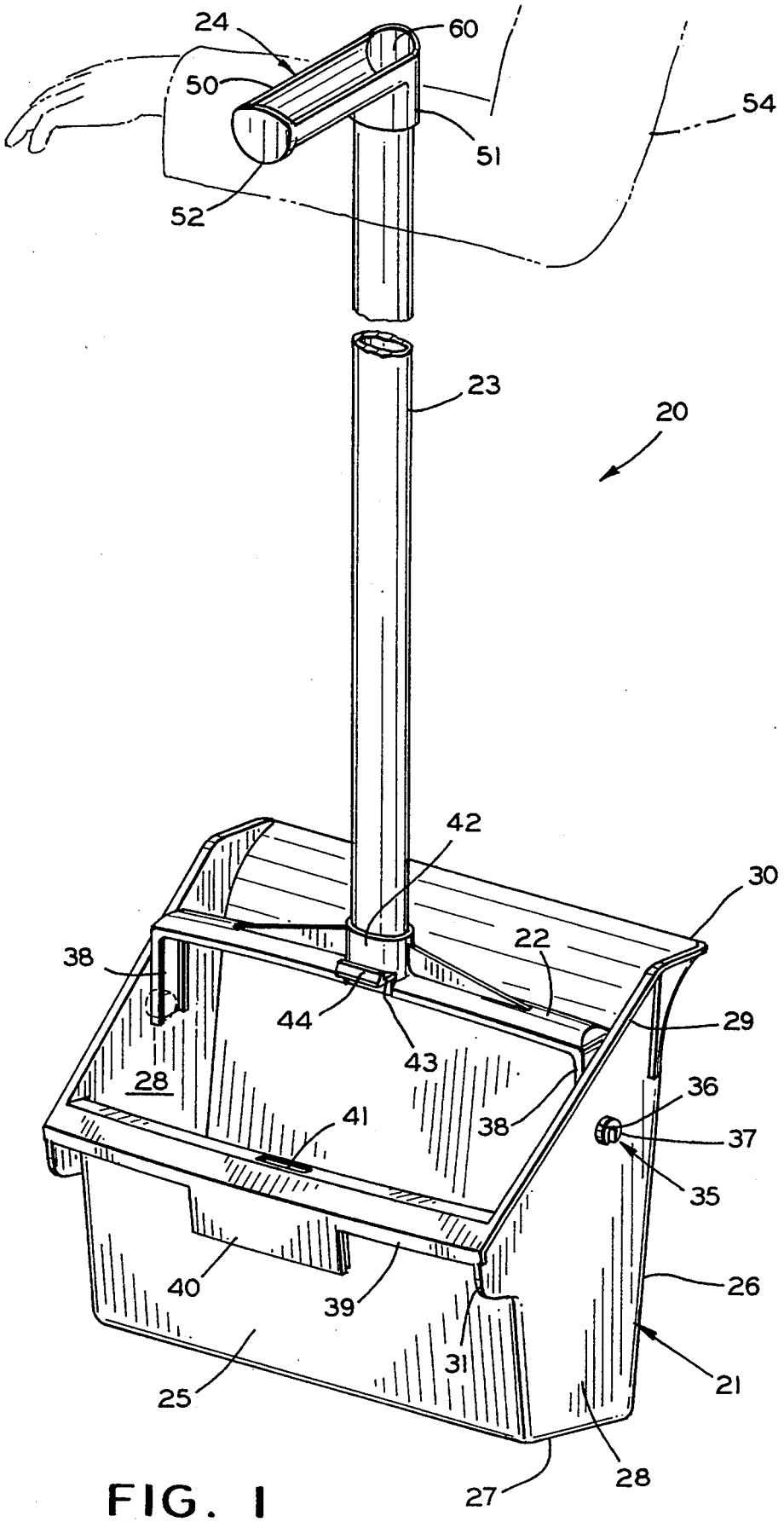
FIG. 1 is a perspective view showing a construction embodying the present invention as it may be carried over the arm of a user between uses.
Figure 2:
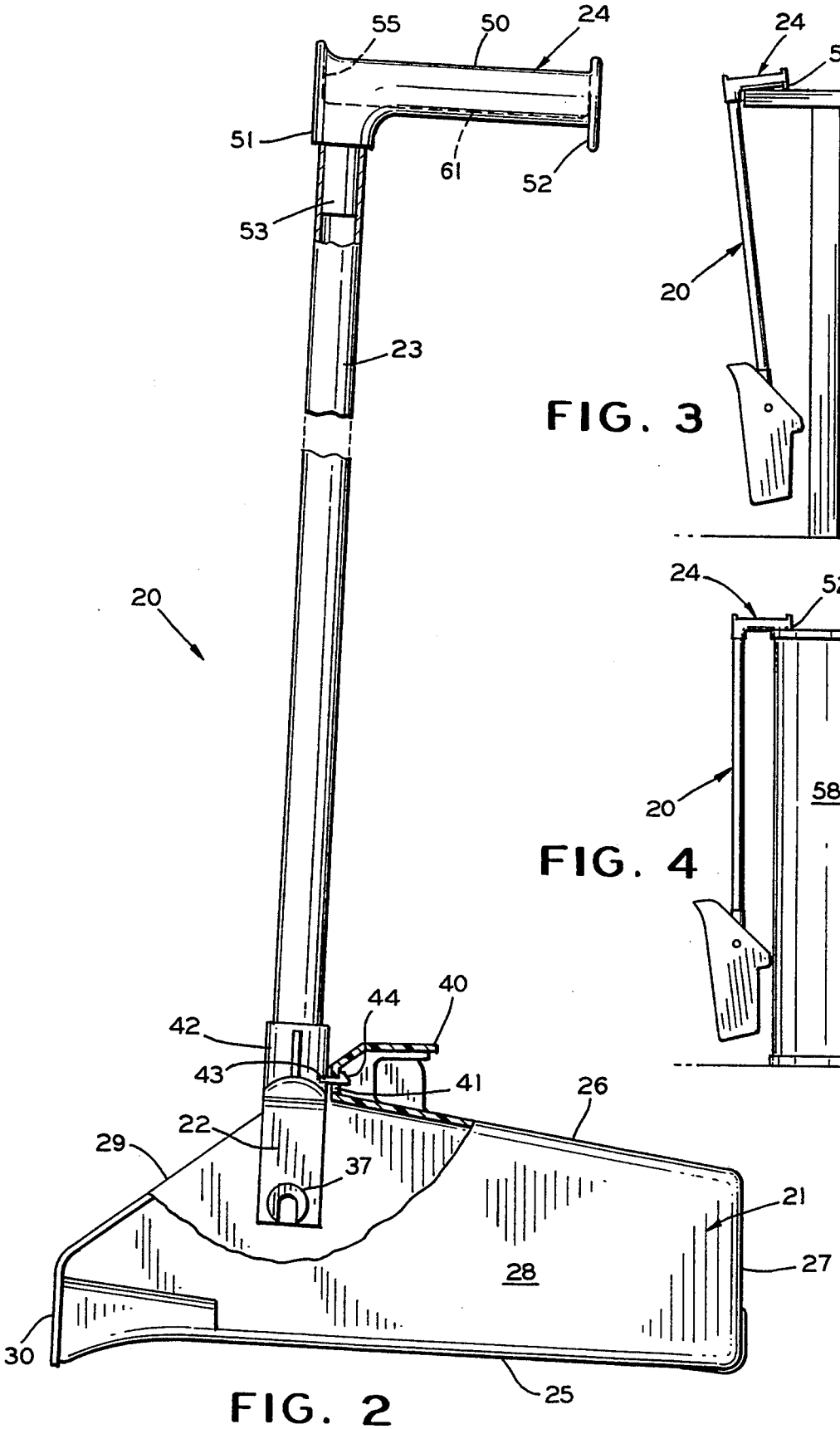
FIG. 2 is an elevational view of the construction shown in FIG. 1, partially cut away for clarity, and showing the shaft in the upright latched position.

Referring now to FIGS. 1 and 2, there is shown a lobby dust pan embodying the construction of the present invention, and generally designated by the numeral 20. Such lobby dust pans generally have a receptacle portion 21 which is pivotally connected to a yoke 22. The yoke 22 is connected to one end of a shaft 23. The other end of the shaft 23 is connected to the handle, generally designated by the numeral 24. The receptacle portion 21 of the lobby dust pan 20 is well known in the art, and typically includes a rear wall 25, front wall 26, a bottom wall 27, and a pair of parallel spaced apart side walls 28. The open ends of side walls 28 generally have a diagonal edge portion 29 forming a lip 30 at one end thereof, and an extension 31 at the other end.

The receptacle portion 21 of the lobby dust pan is shown in a transit or resting position in FIG. 1. The active position of the dust pan is shown in FIG. 2. The receptacle 21 is mounted to the shaft 23 by rotary or pivotal hinge means generally designated by the numeral 35. Such pivotal hinge means 35 include a pair of axially aligned connecting openings 36 provided in the side walls 28 of the receptacle 21. A pair of mounting pins 37 are mounted in a 180° opposed relationship to a pair of downwardly depending legs 38 forming a part of the yoke 22.

Also generally found on lobby dust pans 20 is a rim portion 39 on which is formed a retaining means 40.

Proximate the midpoint of the retaining means 40 is provided a slot 41. A shaft receiving or mounting means 42 is provided at the upper extremity of the yoke 22. A tab 43 having a laterally extending hook-like portion 44 is formed integrally with the shaft mounting means 42.

As best seen in FIG. 2, when the receptacle 21 is placed on the surface to be cleaned, it will assume a horizontal position. The handle 24 and associated shaft 23 are shown in an upright or locked position. In order to assume the position illustrated in FIG. 2, slight downward pressure is initially imposed on the handle 24. The pressure is transmitted through the shaft 23 and slightly deforms the body of the yoke 22 causing the tab 43 to move downward slightly. A rotation of the handle 24 (and shaft 23) in the clockwise direction will cause the hook-like portion 44 of the tab 43 to enter and travel through the slot 41. When the operator releases the downward pressure on the handle 24, the tab 43 and hook 44 move upward, and the handle 24 and the shaft 23 will be retained in the upright position for use by appropriate personnel. It can be seen that the lobby dust pan may be lifted and lowered many times and the receptacle portion 21 will remain in the horizontal or active position in the absence of a conscious effort to disengage the tab 43 from the slot 41.

It can be easily understood that when a person has completed the cleaning of a particular area, and wants to transport the lobby dust pan and the waste collected therein to another work area, a slight downward pressure on the handle 24 will again slightly deform the yoke 22 and permit release of the tab 43. A slight counter-clockwise rotation about the axis of the connecting openings 36 will remove the tab from the slot. Lifting on the handle 24 will permit the receptacle 21 to assume a vertical or inactive position.

It is in the moving from one work station to another that the novelty and usefulness of the new handle of the present lobby dust pan can be fully appreciated. The handle 24 has a body portion 50, a connecting portion 51, and a downwardly extending transverse ridge portion or end wall 52. For mounting the handle 24 to the shaft 23, a downwardly depending protuberance 53 on the connecting portion 51 of the handle 50 is press-fit into the end of the shaft 23. The dimensions are such that a permanent connection is made.

Figure 3:
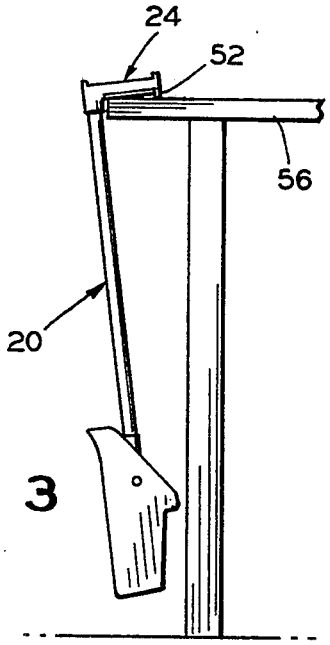
FIG. 3 is an elevational view showing how the construction of FIG. 1 may be hooked over the edge of a table.
Figure 4:
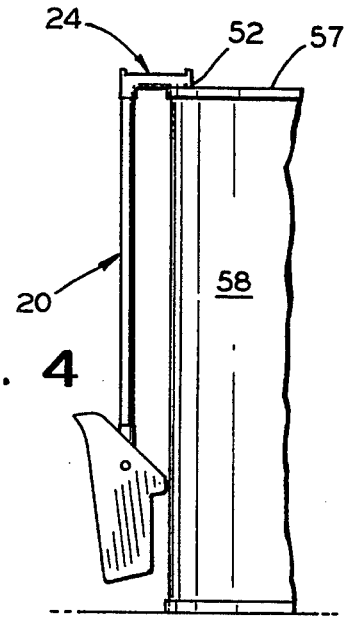
FIG. 4 is an elevational view showing how the construction shown in FIG. 1 may be hooked over the rim of a container.

Referring to FIGS. 1, 3 and 4, the advantages of the improved handle construction are easily seen. The old ball-shaped handle of prior art lobby dust pans required constant gripping pressure to be applied while carrying the dust pan from job site to job site. This caused excess user fatigue. Due to the shape of the improved handle of the present invention, it may easily be carried over the arm 54 of the user. The ridge shaped portion 52, in combination with the axially extending body portion 50, prevents the handle, and therefore, the lobby dust pan, from sliding off the arm of the operator. In addition, the operator's hands are freed for other tasks, such as carrying cleaning utensils or tools from work station to work station.

As shown in FIG. 2, a hollowed-out trough portion 55 may be provided in the top of the handle 24 to provide a comfortable hand grip for the user. The user, by placing his thumb in the trough, may easily apply downward pressure to the shaft 23 when needed. When the trough or depression 55 is provided, a curved, comfortable to use, upstanding end wall 60 is provided against which the operator's thumb may be braced while applying pressure to the handle 24. This is an additional ergonomic benefit provided by the present invention. A hole or opening 61 may also be provided in handle 24.

As shown in FIGS. 3 and 4, not only is the fatigue reduced for the operator, but a convenient means of temporarily placing the lobby dust pan in a resting position is provided. As shown in FIG. 2, because of the ridge-shaped portion 52 of the handle 24, the lobby dust pan 20 may easily be hung over the edge of the table 56 for temporary storage.

Likewise, as shown in FIG. 4, the handle 24, and thus, the lobby dust pan 20, may easily be hung over the rim 57 of the barrel or receptacle 58.

Thus, by carefully analyzing the requirements and problems associated with present day cleaning equipment, a novel lobby dust pan is provided which is more convenient and less fatiguing to use.

What is claimed is:

1. A lobby dust pan comprising:

a) a receptacle which includes a generally flat, rectangular bottom wall, a rear wall extending transversely from the bottom wall, a front wall extending transversely, in the same direction as said rear wall, from the bottom wall to a height greater then the rear wall, said front and rear wall being spaced apart, and a pair of side walls extending transversely from the bottom wall, in the same direction as said rear wall, each side wall being coupled with the front and rear walls to form a continuous upper edge of all the walls which defines an aperture into said receptacle;

b) retaining means formed in the upper edge of the rear wall for engaging a latching means, said retaining means including a slot formed in the upper edge;

c) a flexible yoke pivotally mounted to said pair of side walls and extending therebetween, said receptacle being pivotal on said yoke between a first position in which the rear wall is generally horizontal and a second position in which the rear wall is generally vertical;

d) an elongated, straight, vertical shaft having a bottom end and a top end, said bottom end is secured to said flexible yoke at a position approximately midway between the pair of side walls, said yoke is movable between a deformed and an undeformed position by application of downward force on said shaft;

e) an elongated handle having a first end connected to a top end of said vertical shaft and extending transversely from said shaft to a second end, said handle having a hollowed out trough portion therein to receive a users thumb, said handle has a transverse downwardly extending end wall formed at the second end of said handle; and f) latching means for holding said yoke in said first position, said latching means formed on said yoke at a position adapted to engage said slot when the receptacle is in the first position, said latching means being retained in said slot, in said first position, when the yoke is in the undeformed position and released from said slot, in said first position, when the yoke is in the deformed position.

2. The lobby dust pan defined in claim 1 wherein the top end of said vertical shaft includes a center aperture, and the first end of said handle includes a downwardly extending protuberance press fit into the center aperture to secure said handle to said vertical shaft.

* * * * *